US006659141B2

(12) United States Patent
Lawrence

(10) Patent No.: US 6,659,141 B2
(45) Date of Patent: Dec. 9, 2003

(54) TOOL FOR BENDING A CEILING SUPPORT ROD

(76) Inventor: Dayle Lawrence, 301 Gilbert Ave., Toronto (CA), M6E 4W8

( * ) Notice: Subject to any disclaimer, the term of this patent is extended or adjusted under 35 U.S.C. 154(b) by 0 days.

(21) Appl. No.: 10/102,589

(22) Filed: Mar. 19, 2002

(65) Prior Publication Data

US 2002/0134454 A1 Sep. 26, 2002

(51) Int. Cl.[7] ..... B21F 1/00
(52) U.S. Cl. ..... 140/106
(58) Field of Search ..... 140/106; 72/387

(56) References Cited

U.S. PATENT DOCUMENTS

| | | | | | |
|---|---|---|---|---|---|
| 41,610 | A | | 2/1864 | Durning | |
| 145,794 | A | | 12/1873 | Fry | |
| 218,083 | A | | 7/1879 | Taylor | |
| 393,494 | A | | 11/1888 | Whipple | |
| 690,933 | A | | 1/1902 | Decker | |
| 874,253 | A | * | 12/1907 | Scott | 140/106 |
| 880,235 | A | | 2/1908 | Neller | |
| 1,268,922 | A | | 6/1918 | Bryan | |
| 1,321,314 | A | | 11/1919 | Kelleher | |
| 1,602,119 | A | * | 10/1926 | Niebaum | 140/106 |
| 1,619,084 | A | * | 3/1927 | Miller | 140/106 |
| 2,857,792 | A | | 10/1958 | McNish | 81/15 |
| 2,957,499 | A | | 10/1960 | James, Jr. | 140/123 |
| 3,179,129 | A | * | 4/1965 | Hahn | 140/106 |
| 3,357,287 | A | * | 12/1967 | Wertepny, Sr. | 81/322 |
| 3,732,721 | A | | 5/1973 | Cusimano | 72/458 |
| 4,413,660 | A | | 11/1983 | Conrad | 140/119 |
| 5,934,138 | A | | 8/1999 | Semien | 72/458 |
| 6,023,959 | A | | 2/2000 | Stratton | 72/458 |
| 6,234,050 | B1 | * | 5/2001 | Konen et al. | 81/427.5 |

* cited by examiner

*Primary Examiner*—Lowell A.. Larson
(74) *Attorney, Agent, or Firm*—Mark Kusner; Michael A. Jaffe

(57) ABSTRACT

A tool for bending ceiling support rods. The tool includes a first lever and a second lever. The first lever has a first handle portion and an associated first jaw portion, the first jaw portion has a contoured surface. The second lever has a second handle portion and an associated second jaw portion, the second jaw portion has an edge. Means are provided for pivotally mounting the first lever with the second lever, wherein the first jaw portion and the second jaw portion are opposite each other and are movable relative to each other when the first and second handle portions are compressed. The edge of the second jaw portion is movable toward the contoured surface of the first jaw portion when the first and second handle portions are compressed toward each other.

15 Claims, 5 Drawing Sheets

TOOL FOR BENDING A CEILING SUPPORT ROD

FIELD OF THE INVENTION

The present invention relates to tools for bending structural elements, and more particularly, to a tool for bending ceiling support rods.

BACKGROUND OF THE INVENTION

Many offices and retail establishments include suspended ceilings, wherein a horizontal framework suspended a predetermined distance from the floor supports a ceiling material, such as drywall or ceiling tiles. The framework is suspended from a support ceiling structure by support rods. Support rods for supporting a drywall ceiling are typically of a larger gauge than support rods used for supporting an acoustic tile ceiling. Each support rod is bent at a predetermined location to support part of the framework. As will be appreciated, each support rod must be bent at the same distance from the floor to assure a level ceiling.

The present invention provides a tool for bending ceiling support rods that support a ceiling framework.

SUMMARY OF THE INVENTION

In accordance with a preferred embodiment of the present invention, there is provided a tool for bending ceiling support rods. The tool includes a first lever having a first handle portion and an associated first jaw portion. The first jaw portion has two, spaced-apart jaw members, each having a jaw edge. A second lever having a second handle portion and an associated second jaw portion is provided. The first lever and the second lever are pivotally mounted to each other, wherein the first jaw portion and the second jaw portion are opposite each other and are movable relative to each other when the first and second handle portions are compressed. The second jaw portion moves along a path between the jaw edges of the jaw members of the first jaw portion when the handle portions are compressed toward each other. The second jaw portion is movable from a first position wherein the second jaw portion is spaced-apart from the first jaw portion to a second position wherein the second jaw portion is disposed between the jaw edges of the first jaw portion.

In accordance with a preferred embodiment of the present invention, there is provided a tool for bending ceiling support rods. The tool includes a first lever and a second lever. The first lever has a first handle portion and an associated first jaw portion, the first jaw portion has a contoured surface. The second lever has a second handle portion and an associated second jaw portion, the second jaw portion has an edge. Means are provided for pivotally mounting the first lever with the second lever, wherein the first jaw portion and the second jaw portion are opposite each other and are movable relative to each other when the first and second handle portions are compressed. The edge of the second jaw portion is movable toward the contoured surface of the first jaw portion when the first and second handle portions are compressed toward each other.

It is an object of the present invention to provide a tool for bending ceiling support rods that support a suspended ceiling.

It is another object of the present invention to provide a tool for bending ceiling support rods that is lightweight and easy to use.

It is another object of the present invention to provide a tool as defined above wherein the tool may be used and operated with one hand.

A still further object of the present invention is to provide a tool as defined above that is formed of two levers, each lever being formed of from a flat, metallic sheet.

These and other objects will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
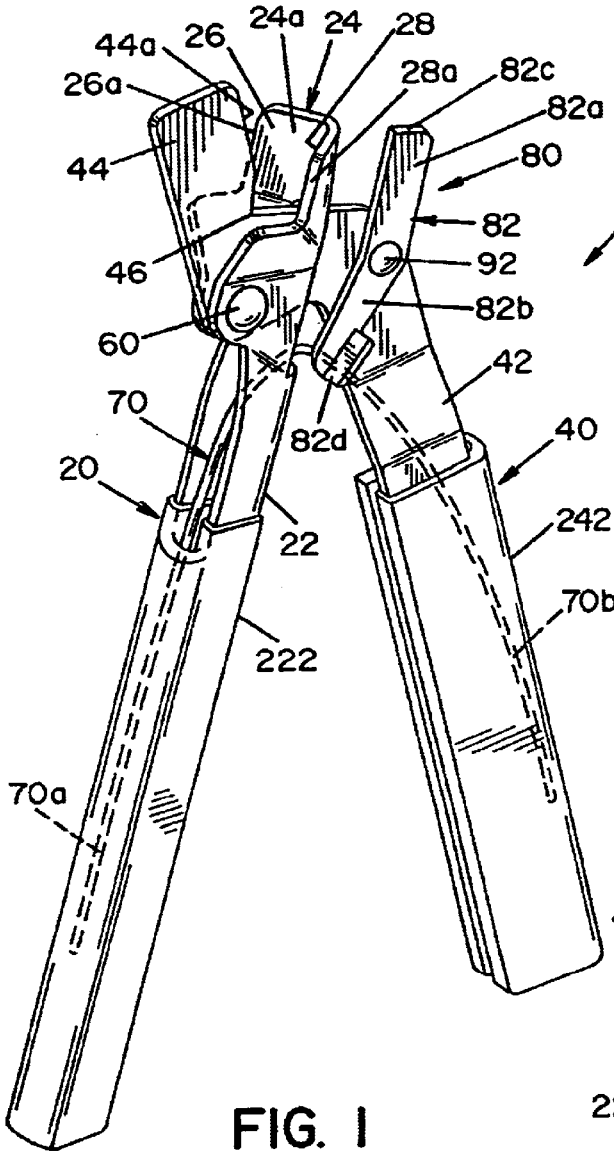
FIG. 1 is a perspective view of a tool for bending ceiling support rods, illustrating a preferred embodiment of the present invention.

Referring now to the drawings wherein the showings are for the purpose of illustrating the preferred embodiment of the invention only, and not for the purpose of limiting same, a tool 10 for bending ceiling support rods is shown. Tool 10 includes a first lever 20 and a second lever 40. Second lever 40 is pivotally mounted to first lever 20 by a pin 60 that allows pivotal movement of first lever 20 relative to second lever 40.

Figure 4:
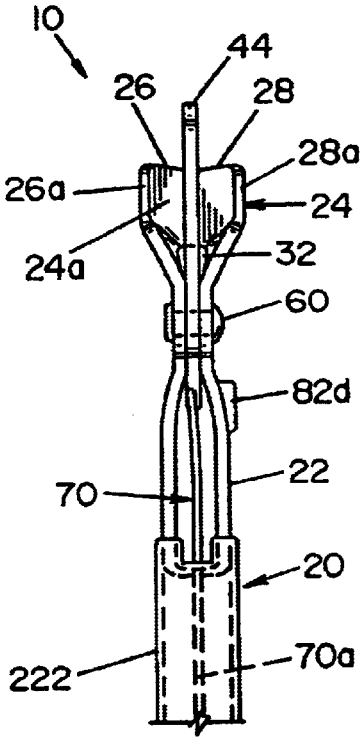
FIG. 4 is a left elevational view of the tool shown in FIG. 2.

First lever 20 includes a handle portion 22 and a jaw portion 24. Jaw portion 24 has a generally contoured surface 24*a* that is used to bend a support rod, as shall be described in greater detail below. While surface 24*a* may assume a number of different concave or inwardly curved or rounded shapes, in the embodiment shown, jaw portion 24 includes two (2) jaw members 26, 28. In the embodiment shown, jaw members 26, 28 are disposed at an angle relative to each other and joined together to form jaw portion 24. Jaw portion 24 is V-shaped and defines a generally V-shaped surface 24*a*. V-shaped surface 24*a* defines an angle of about 90°. Jaw members 26, 28 have outer edges 26*a*, 28*a*, respectively, that are spaced apart, as best seen in FIG. 4. Edges 26*a*, 28*a* are parallel to each other.

Figure 5:
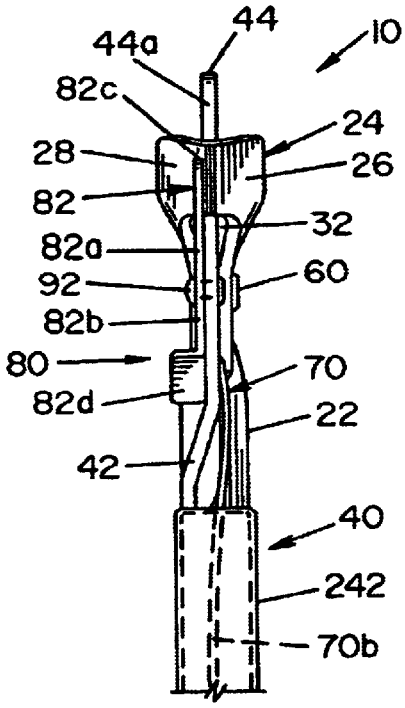
FIG. 5 is a right elevational view of the tool shown in FIG. 2.
Figure 6:
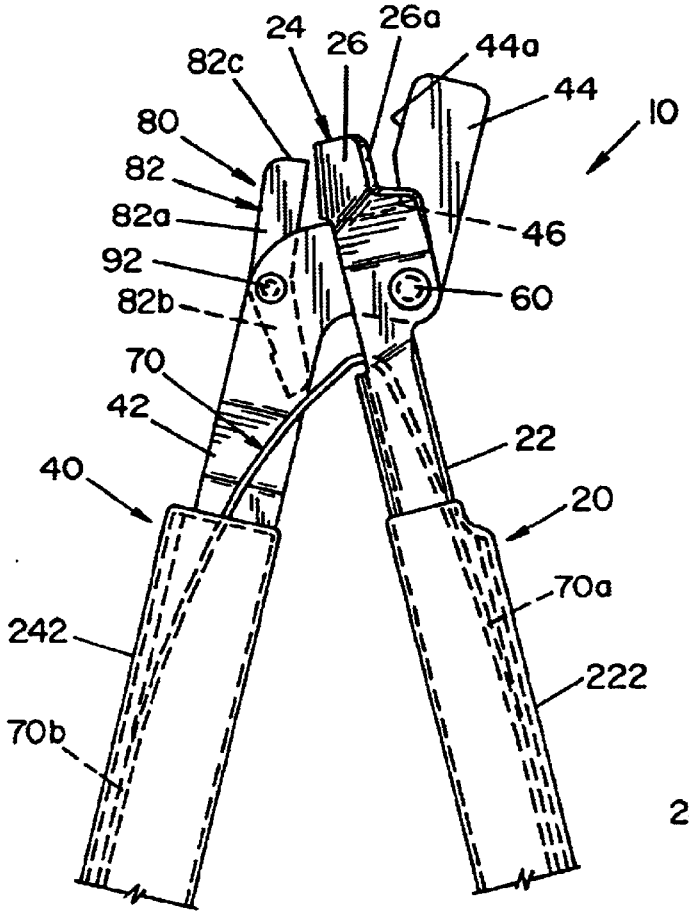
FIG. 6 is a rear elevational view of the tool shown in FIG. 2.
Figure 11:
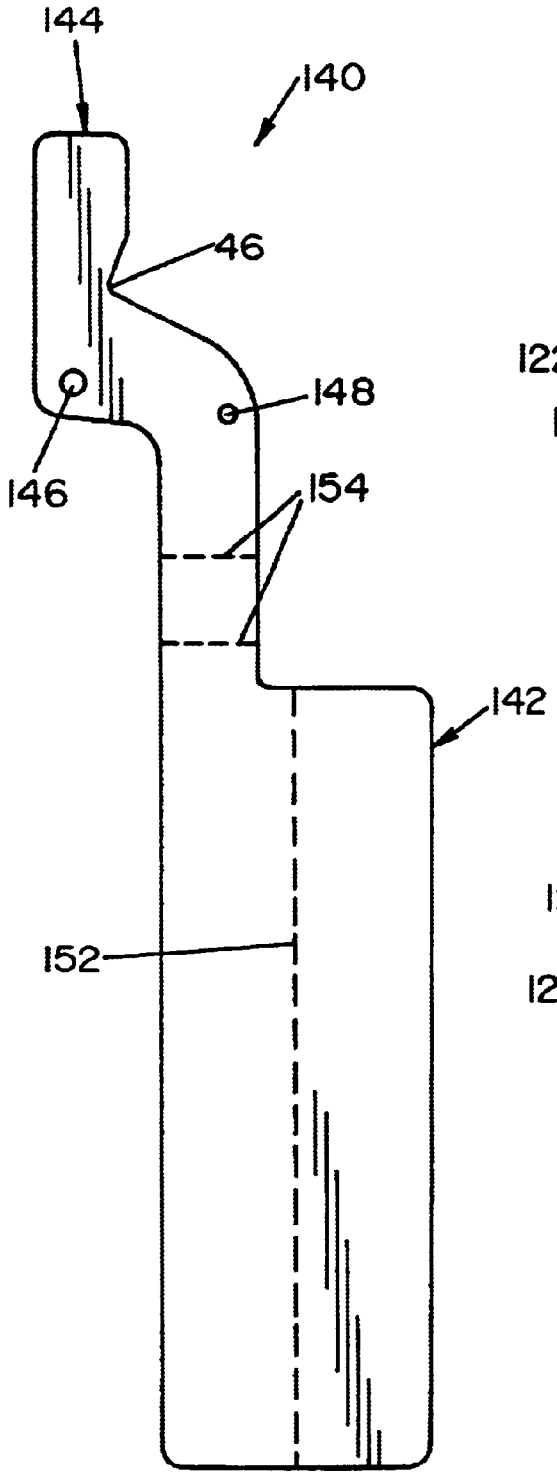
FIG. 11 is a developed view of a preformed metal piece used to form a first lever of the tool.

A slot or opening 32, best seen in FIG. 5, is formed through first lever 20 between handle portion 22 and jaw portion 24. Slot portion 32 is dimensioned to receive second lever 40 therethrough, as shall be described in greater detail below. Second lever 40 includes a handle portion 42 and jaw portion 44. Jaw portion 44 is basically a flat, planar element having an edge 44*a*. A notch or recess 46 is formed along jaw edge 44*a*, as best seen in FIGS. 6 and 11. Jaw portion 44 is oriented to lie in a plane that bisects jaw portion 24 of first lever 20. In this respect, second jaw portion 44 bisects surface 24*a* of first jaw portion 24.

First lever 20 is pivotal relative to second lever 40 such that edge 44*a* of jaw portion 44 is parallel to jaw edges 26*a*, 28*a* of jaw portion 24 and is movable therebetween. In this respect, planar jaw portion 44 basically bisects and is movable toward surface 24*a* of first jaw portion 24, and engages surface 24*a* at the point where jaw members 26, 28 are joined. In this respect, first lever 20 and second lever 40 are movable between a first opened position, wherein jaw portion 24 is spaced apart from jaw portion 44 when handle portion 22 of first lever 20 is spaced apart from handle portion 44 of second lever 40, and a second, closed position wherein jaw portion 44 abuts surface 24*a* of jaw portion 24 when handle portion 22 of first lever 20 and handle portion 42 of second lever 40 are compressed together.

A biasing element 70 is provided to bias handle portion 22 and handle portion 42 away from each other. In the embodiment shown, biasing element 70 is an elongated length of a resilient, spring metal having a normal, straight configuration. Biasing element 70 has two (2) leg sections 70*a*, 70*b* that engage respectively handle portions 22, 42 and bias handle portions 22, 42 away from each other.

A locking mechanism 80 is provided to lock first lever 20 and second lever 40 in a closed position, wherein tool 10 is in a compact configuration with handle portion 22 of first lever 20 adjacent to handle portion 42 of second lever 40. Locking mechanism 80 is comprised of a locking lever 82 that is pivotally mounted to second lever 40 by a pin 92. Locking lever 82 has a first arm 82*a* and second arm 82*b*. First arm 82*a* has a free end 82*c*. Second arm 82*b* has an end that is bent to define a tab 82*d* that extends generally perpendicular to second arm 82*b*. The operation of the locking mechanism 80 shall be described below.

Figure 12:
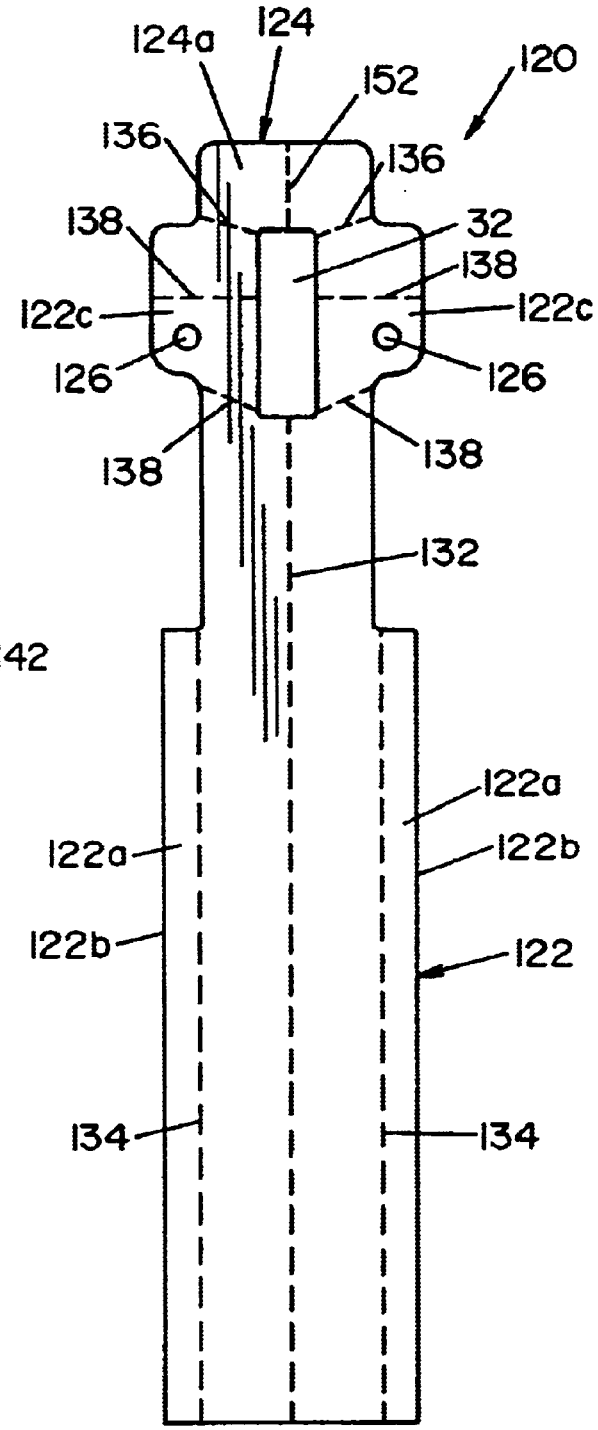
FIG. 12 is a developed view of a preformed metal piece used to form a second lever of the tool.

Referring now to FIGS. 11 and 12, tool 10 shall further be described with respect to a method of forming the same. Tool 10 is preferably formed of a metallic material, and may be formed of a number of different processes, such as casting or forging. In the embodiment shown, tool 10 is formed from a flat, metallic sheet material, wherein first lever 20 and second lever 40 are formed respectively from a pair of flat, preforms 120, 140 that are die stamped from a metallic sheet material.

Figure 2:
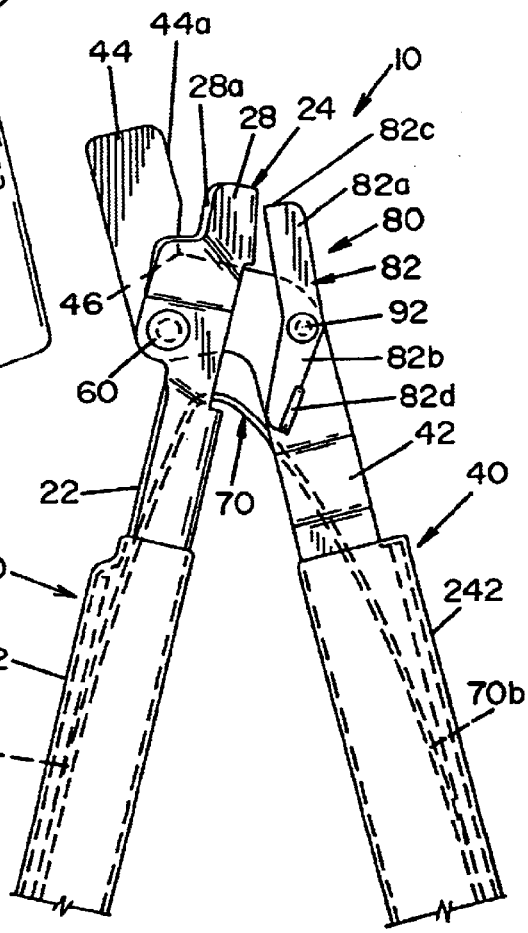
FIG. 2 is a front elevational view of the rod shown in FIG. 1.
Figure 3:
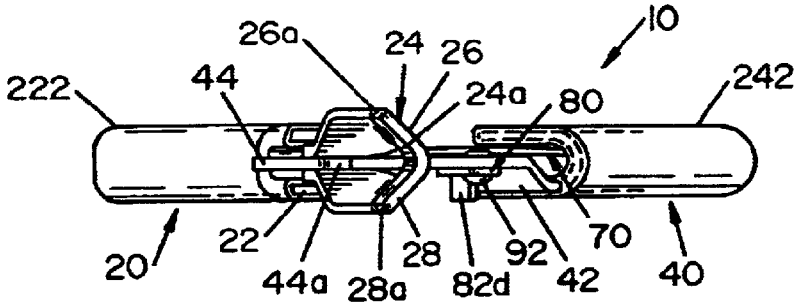
FIG. 3 is a top plan view of the tool shown in FIG. 2.
Figure 7:
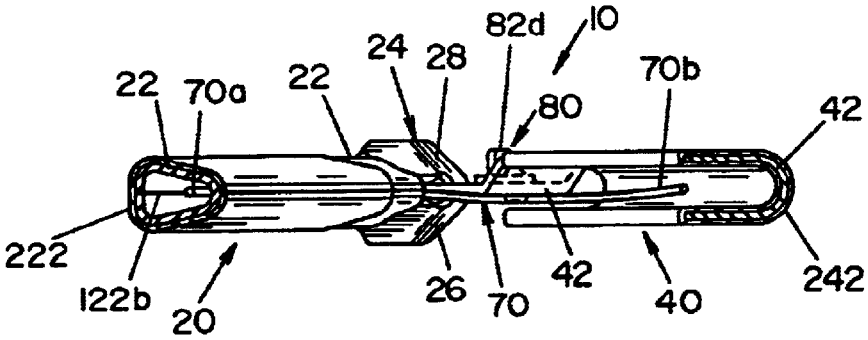
FIG. 7 is a bottom plan view partially in section of the tool shown in FIG. 2.
Figure 8:
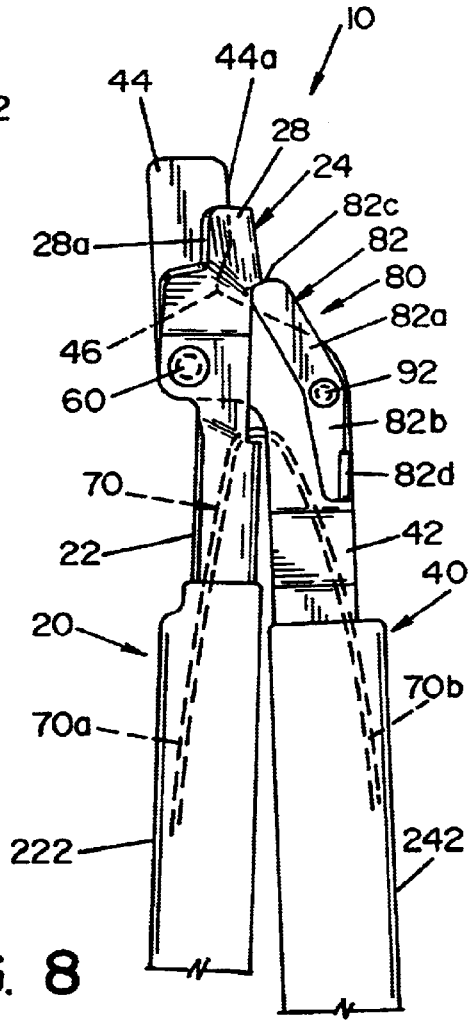
FIG. 8 is a view similar to FIG. 2, showing the tool locked in a closed position.

First lever preform 120, best seen in FIG. 12, includes a preform handle portion 122 and a preform jaw portion 124. Handle portion 122 is basically rectangular in shape and includes side sections 122*a* having straight edges 122*b* and intermediate sections 122*c*. As seen in FIG. 12, holes 126 are formed in sections 122*c*. Slot 32, as described above, is formed in first lever preform 120. A pair of spaced-apart holes 126, dimensioned to receive pivot pin 60, are also formed in first lever preform 120. First lever preform 120 is dimensioned to be bent along a central axis, designated 132 in the drawings, by a die forming operation or the like, to bend lever preform 120 into a generally U-shaped configuration. Side sections 122*a* of preform handle portion 122 are adapted to be bent along bend lines 134 wherein straight edges 122*b* of side section 122*a* are brought together to form a closed handle portion 22, as best illustrated in FIG. 7. Jaw portion 124 of first lever preform 120 is bent along bend axis 152 to define V-shaped jaw portion 24 and shaped surface 124*a*. In the embodiment shown, preform jaw portion 124 is bent to define jaw members 26, 28, wherein jaw members 26, 28 are flat, planar elements that are oriented at an angle of about 90° relative to each other. As will be appreciated by those skilled in the art from a further reading of the specification, jaw members 26, 28 may be disposed relative to each other at angles less than 90°. After V-shaped jaw portion 24 is formed, V-shaped jaw portion 24 is bent slightly toward the position of jaw portion 44, as best seen in FIGS. 2 and 8. Bending of jaw portion 24 relative to formed handle portion 22 produces bend lines illustrated and designated 136 in FIG. 12.

Lever preform 120 is further shaped and formed to cause intermediate sections 122*c* to be bent and shaped along bend lines 138 into a generally U-shaped configuration wherein the portion of intermediate sections 122*c* having holes 126 therethrough are basically parallel to each other, as best seen in FIG. 4.

Referring now to FIG. 11, second lever preform 140 is shown. Second lever preform 140 has a preform handle portion 142 and a preform jaw portion 144. Preform jaw portion 144 is shaped to define jaw portion 44 and notch 46 as discussed above. A hole 146 is formed in lever preform 140 to receive pivot pin 60. A second hole 148 is formed in lever preform 140 for mounting locking mechanism 80. Preform handle portion 142 is dimensioned to be bent along a bend axis 152, to define a generally U-shaped handle portion 42, as best seen in FIG. 7.

Tool 10 is assembled by inserting jaw portion 44 of second lever 40 through slot 32 and first lever 20. Hole 146 in second lever 40 is aligned with holes 126 in first lever 20, and pin 60 is inserted therethrough. The end of pin 60 is flared, as conventionally known, to maintain and lock pin 60 in position, and to allow pivotal movement of first lever 20 relative to second lever 40. In a similar fashion, locking mechanism 80 is mounted to second lever 40 by a pin 92 to allow pivotal movement of locking lever 82 relative to second lever 40.

Biasing element 70 is attached to tool 10 by inserting leg section 72*a* of biasing element 70 through opening 32 in first lever 20 into the space defined by first handle portion 22, as best illustrated in FIG. 2. As indicated above, in the embodiment shown, biasing element 70 is an elongated length of spring metal having a normally straight configuration. Leg section 72*b* is then bent relative to leg section 72*a* and positioned into the space defined by U-shaped handle portion 42, as best seen in FIG. 2. Bending biasing element 70 from its normal straight configuration produces a biasing force on handle portions 22, 42 that biases handle portions 22, 42 away from each other, as biasing element 70 tries to resume its normal, straight configuration.

In the embodiment shown, polymer handle grips 222, 242 are provided on handle portions 22, 42, respectively. Handle grips 222, 242 may be prefromed and assembled onto handle portions 22, 42, but in a preferred embodiment, handle grips 222, 242 are formed by inserting handle portions 22, 42 into a bath (not shown) of a heated, softened polymer material, removing the handles from the bath and allowing the polymer material attached to handle portions 22, 42 to cool and harden, as is conventionally known.

Tool 10 is dimensioned to be held and used by one hand. In this respect, tool 10 is dimensioned to have an overall length of about 6 to 12 inches. In a preferred embodiment, tool 10 is about 8½ inches in length.

Referring now to the use and operation of tool 10, tool 10 is used for bending a ceiling support rod for supporting a suspended ceiling. As indicated above, to insure a level ceiling, each support rod must be bent at the same distance from the floor surface to insure a level ceiling. It is typically known to establish the location where the rods are to be bent by using a laser elevated above the floor that shoots a horizontal laser beam across a room. The laser beam establishes a reference mark on each of the support rods where a support rod is to be bent.

Figure 9:
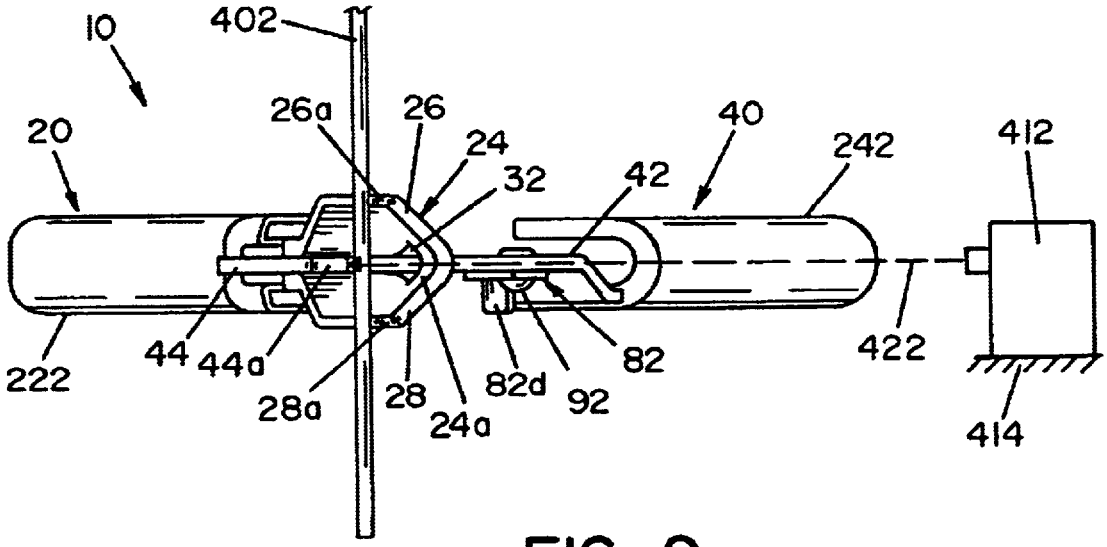
FIG. 9 is an end view of the tool showing the operative end of the tool in a first position relative to a ceiling support rod to be bent.
Figure 10:
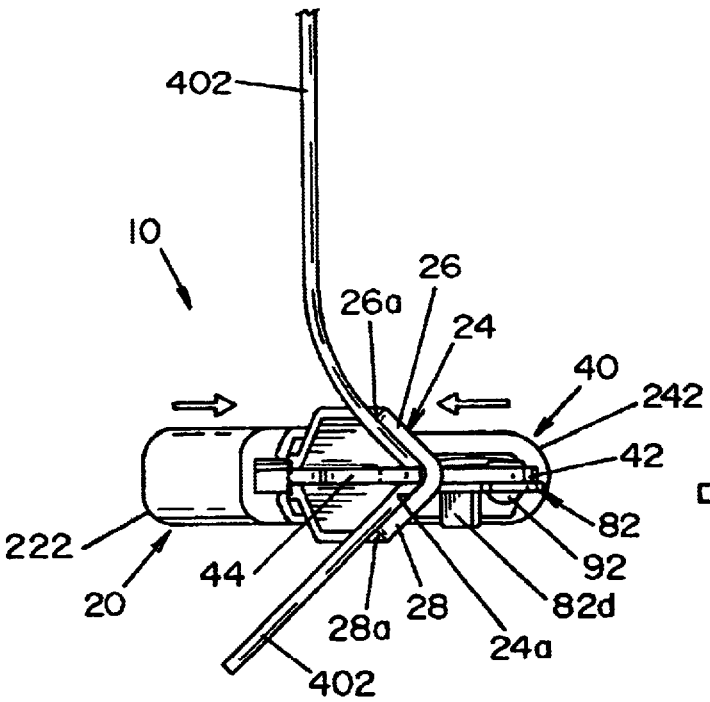
FIG. 10 is an end view of the tool showing the operative end of the tool in a second position at the moment when the ceiling support rod is bent by compression of the tool.
Figure 10A:
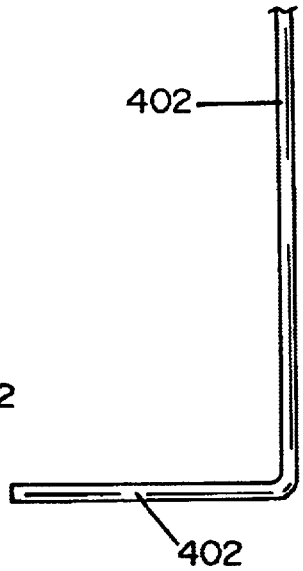
FIG. 10A is a view of a bent ceiling support rod after release from the tool.

FIGS. 9 and 10 schematically illustrate the use of tool 10 in bending a ceiling support rod, designated 402 in the drawings. A laser device 412 is schematically illustrated resting on a support surface 414. Laser device 412 is positioned and oriented to emit a horizontal beam of light 422 that intersects support rod 402 and establishes the desired location to bend support rod 402. With jaw portions 24, 44 spaced apart, an installer positions tool 10 such that jaw portion 44 of second lever 40 is aligned with light beam 422, as illustrated in FIGS. 9 and 10. In this position, support rod 402 is disposed within notch 46 of jaw portion 44, and jaw edge 44*a* is disposed on one side of the support rod (aligned with the laser beam) and jaw edges 26*a*, 28*a* are disposed on the opposite side of the support rod. The installer then compresses handle portions 22, 42 together thereby closing jaw portions 24, 44 wherein jaw edge 44*a* forces support rod 402 against jaw edges 26*a*, 28*a* and begins to bend support rod 402 by forcing support rod 402 toward V-shaped surface 24*a* defined by jaw portion 24. Further compression of handle portions 22, 42 forces support rod 402 against V-shaped surface 24*a* of jaw portion 24 and permanently bends support rod 402 to 90° or more relative to the upper portion of the support rod, as illustrated in FIG. 10. By aligning the planar jaw portion 44 with laser beam 422, each support rod 402 supporting a ceiling structure can be bent at the same elevation as established by laser beam 422. As indicated above, tool 10 is preferably dimensioned for use by one hand.

The present invention thus provides a lightweight, simple tool that greatly accelerates installation of a suspended ceiling structure by enabling rapid bending of support rods by an installer using only one hand. A tool as described above is capable of efficiently bending support rods ranging in gauge size from 9 to 12, as is conventionally known for supporting drywall and acoustic tile ceilings. (At gauges above 12, tool 10 may not be required as such gauges may be bendable by hand). By freeing the other hand of the installer, the installer can use his free hand for balance or to manipulate the bent section of the support rod.

The foregoing description is a specific embodiment of the present invention. It should be appreciated that this embodiment is described for purposes of illustration only, and that numerous alterations and modifications may be practiced by those skilled in the art without departing from the spirit and scope of the invention. For example, although tool 10 was described as being formed from a metallic sheet material, tool 10 may be formed from cast or forged metal parts without deviating from the present invention. Further, construction of tool 10 is not limited to the temporal order of the steps described above. Still further, while a V-shaped jaw surface was described with respect to a preferred embodiment, other contoured surfaces, such as by way of example and not limitation, a rounded, parabolic or elliptical concave surface having jaw edges may also find advantageous application in the present invention. It is intended that all such modifications and alterations be included insofar as they come within the scope of the invention as claimed or the equivalents thereof.

Having described the invention, the following is claimed:

1. A one-hand tool for bending ceiling support rods, comprised of:

a first lever formed from flat, metallic sheet material having a first handle portion and an associated first jaw portion, said first jaw portion having two, spaced-apart jaw members that form a generally V-shaped surface, said first jaw portion being an integral part of said first handle portion;

a second lever formed from flat, metallic sheet material having a second handle portion and an associated second jaw portion, said second jaw portion being an integral part of said second handle portion; and means for pivotally mounting said first lever with said second lever, wherein said second lever extends through said first lever and wherein said first jaw portion and said second jaw portion are opposite each other and are movable relative to each other when said first and second handle portions are compressed, said second jaw portion movable along a path that moves along a path that bisects and abuts said V-shaped surface of said first jaw portion when said handle portions are compressed toward each other, said second jaw portion being movable from a first position wherein said second jaw portion is spaced-apart from said first jaw portion to a second position wherein said second jaw portion is disposed in said V-shaped surface of said first jaw portion.

2. A tool for bending ceiling support rods as defined in claim 1, further including a biasing element to bias said handle portions apart.

3. A tool for bending ceiling support rods as defined in claim 1, further including a locking mechanism for locking said tool in a closed position.

4. A tool for bending ceiling support rods as defined in claim 1, wherein said second jaw portion includes a notch formed therein to capture a ceiling rod.

5. A tool for bending ceiling support rods as defined in claim 1, wherein said first and second handle portion are formed by bending said flat, metallic sheet material, said metallic sheet material being bent to define contoured handle portions including U-shaped cross-sections.

6. A tool for bending ceiling support rods as defined in claim 5, wherein said first and second handle portions have a polymer grip thereon.

7. A tool for bending ceiling support rods as defined in claim 5, wherein said metallic sheet material is cold-rolled hardened steel.

8. A one-hand tool for bending ceiling support rods, comprised of:

a first lever formed from flat, metallic sheet material having a first handle portion and an integral first jaw portion, said first jaw portion having a V-shaped surface;

a second lever formed from flat, metallic sheet material having a second handle portion and an integral second jaw portion, said second jaw portion having an edge; and means for pivotally mounting said first lever with said second lever, wherein said second lever extends through said first lever and is mounted thereto by a pin and wherein said first jaw portion and said second jaw portion are opposite each other with said contoured surface of said first jaw portion facing said second jaw portion and are movable relative to each other when said first and second handle portions are compressed, said edge of said second jaw portion being movable toward said V-shaped surface of said first jaw portion when said first and second handle portions are compressed toward each other.

9. A tool for bending ceiling support rods as defined in claim 8, wherein said second jaw portion is a flat, planar element that moves along a path that bisects and abuts said V-shaped surface of said first jaw portion.

10. A tool for bending ceiling support rods as defined in claim 9, wherein said second jaw portion includes a notch formed therein to capture a ceiling rod.

11. A tool for bending ceiling support rods as defined in claim 8, further including a biasing element to bias said handle portions apart.

12. A tool for bending ceiling support rods as defined in claim 11, further including a locking mechanism for locking said tool in a closed position.

13. A tool for bending ceiling support rods, comprised of:

a first lever formed from flat, metallic sheet material having a first handle portion and an integrally formed first jaw portion, said first jaw portion having a generally V-shaped surface;

a second lever formed from flat, metallic sheet material having a second handle portion and an integrally formed second jaw portion, said second jaw portion having an edge, each of said handle portions being formed by bending said flat, metallic sheet material into a generally U-shaped configuration along an axis that extends along the handle portion; and means for pivotally mounting said first lever with said second lever, wherein said first jaw portion and said second jaw portion are opposite each other with said contoured surface of said first jaw portion facing said second jaw portion and are movable relative to each other when said first and second handle portions are compressed, said edge of said second jaw portion being movable toward said generally V-shaped surface of said first jaw portion when said first and second handle portions are compressed toward each other.

14. A tool as defined in claim 13, wherein said hand tool has an overall length of about 6 to 12 inches.

15. A tool as defined in claim 14, wherein said hand tool has an overall length of about 8½ inches.

* * * * *